United States Patent [19]

Lowthorp

[11] 4,127,752

[45] Nov. 28, 1978

[54] TACTILE TOUCH SWITCH PANEL

[75] Inventor: Blaine G. Lowthorp, Northfield, Minn.

[73] Assignee: Sheldahl, Inc., Northfield, Minn.

[21] Appl. No.: 841,931

[22] Filed: Oct. 13, 1977

[51] Int. Cl.[2] ..... H01H 13/70

[52] U.S. Cl. ..... 200/5 A; 200/159 B; 200/275; 200/308; 200/340

[58] Field of Search ..... 200/1 R, 5 R, 5 A, 86 R, 200/67 DB, 159 R, 159 B, 275, 302, 308, 340

[56] References Cited

U.S. PATENT DOCUMENTS

| | | | |
|---|---|---|---|
| 3,472,974 | 10/1969 | McGough | 200/5 A |
| 3,591,749 | 7/1971 | Comstock | 200/159 B X |
| 3,643,041 | 2/1972 | Jackson | 200/5 A |
| 3,705,276 | 12/1972 | Seeger, Jr. et al. | 200/5 A |
| 3,721,778 | 3/1973 | Seeger, Jr. et al. | 200/5 R |
| 3,732,387 | 5/1973 | Berry | 200/159 R |
| 3,742,157 | 6/1973 | Leposanic | 200/5 A |
| 3,761,944 | 9/1973 | Shimojo | 200/159 B X |
| 3,796,843 | 3/1974 | Durkee et al. | 200/5 A |
| 3,806,673 | 4/1974 | Boulanger | 200/5 A |
| 3,860,771 | 1/1975 | Lynn et al. | 200/5 A |
| 3,862,381 | 1/1975 | Glaister et al. | 200/5 A |
| 3,862,382 | 1/1975 | Glaister et al. | 200/5 A |
| 3,879,586 | 4/1975 | DuRocher et al. | 200/5 A |
| 3,886,012 | 5/1975 | Slater | 200/5 A X |
| 3,932,722 | 1/1976 | Obata et al. | 200/340 |
| 4,066,860 | 1/1978 | Kawasaki | 200/308 |

*Primary Examiner*—James R. Scott

*Attorney, Agent, or Firm*—Orrin M. Haugen; Thomas J. Nikolai

[57] ABSTRACT

A touch panel diaphragm-type switch array providing improved tactile feedback. A rigid substrate having a printed circuit conductor pattern thereon, with the pattern defining a plurality of switch locations, each including first and second separate electrical contacts is provided and superimposed thereover is a spacer having apertures in registration with the electrical contact pairs. Sandwiched between the substrate and the spacer is a thin layer of a suitable plastic material which is deformed in the areas defined by the apertures in the spacer to define dome-shaped projections surrounded by an annular ring. A bridging conductor is disposed on the underside of the dome-shaped projections. "Spider" members are supported by the side walls of the apertures and are disposed between the outer side of the dome-shaped projections and a flexible plastic cover layer which is affixed to the top side of the spacer layer. The cover layer is imprinted with indicia to visually define the switch positions. Depression of the cover layer with a finger acts through the spider to invert the dome to thereby bring the bridging conductor into electrical engagement with the first and second switching contacts on the substrate. A positive feel is imparted to the finger as the dome inverts and the electrical contact is established.

7 Claims, 8 Drawing Figures

TACTILE TOUCH SWITCH PANEL

BACKGROUND OF THE INVENTION

I. Field of the Invention

This invention relates generally to electrical switch panels and more particularly to the novel design of a switch panel in which a positive indication is given to the operator that a switch contact has been established. Panels of the type involved herein find wide application in a variety of electrical devices including hand calculators, typewriter type keyboards, and computer alphanumeric input panels.

II. Description of the Prior Art

Diaphragm-type switches in which a force is applied to a membrane to thereby deform it through an aperture in a spacer and establish electrical contact with a pattern of conductors disposed at the bottom of the aperture have long been used and are well known in the art. Typical of these prior art diaphragm-type touch panels is that described in the Comstock U.S. Pat. No. 3,591,749 and the IBM Technical Disclosure Bulletin, Vol. 14, No. 3 dated August 1971 and entitled "Elastic Diaphragm Switch" by L. H. Sedaris and K. B. Stevens. Still another prior art patent is U.S. Pat. No. 3,600,528 to Leposavic. The switch panels made in accordance with the aforementioned IBM Technical Disclosure Bulletin and the Leposavic patent are not altogether satisfactory in that they do not provide a positive indication to the operator by way of tactile feedback to indicate that a switch closure has been accomplished. Various attempts have been made to achieve tactile feedback through the use of the so-called "oil-can effect" wherein the diaphragm is bowed slightly upward and when depressed through its median line provides a snap feel and possibly an audible click, the diaphragm returning to its original position when the finger force is removed. One such arrangement is disclosed in the Lynn et al. U.S. Pat. No. 3,860,771 which discloses the use of a dome-shaped projection integrally formed with a cylindrical pedestal, there being a conductive material on the underside of the dome. The dome inverts through the pedestal and through an underlying spacer to bridge contacts on a hard board when force is applied. When the force is released, the oil-can effect restores the dome to its normal arched, non-contacting position.

Devices made in accordance with certain aspects of the prior art suffer from a defect which may be termed "edge toggle". Edge toggle occurs when only one portion of the dome collapses to produce tactile feedback, or when one portion of the dome collapses late and produces a double tactile feedback sensation. This edge toggle always occurs along a crease line where the slope of the crease's center wall approaches the vertical. Five characteristics of edge toggling may be observed and are as follows:

1. the action is not concentric and proceeds from the center of the dome to only one segment of the outer circumference thereof;

2. the collapse of the dome is not catastrophic and does not always go to completion;

3. movement of the flexible dome material is not always isolated within the dome and tends to lift the surrounding circuit;

4. the tactile feedback sensation is very dependent upon the location on the dome where the force is applied;

5. the tactile feedback is not constant and may be different every time the dome is collapsed.

It is a principal object of the present invention to provide a switch panel comprising a plurality of diaphragm-type switches in which the problem of edge toggling is obviated.

SUMMARY OF THE INVENTION

In accordance with the present invention, a rigid substrate is provided which has a printed circuit conductor pattern thereon, the pattern defining a plurality of switch locations. At each switch location there are first and second separate electrical contacts. Superimposed over the substrate is an insulating spacer which has a plurality of openings formed therein. When positioned over the substrate, the openings in the spacer are in registration with the plurality of first and second electrical contacts formed on the substrate. Sandwiched between the substrate and the spacer layer is a thin layer of a suitable plastic material, e.g., Mylar polyester material, which is deformed in the areas defined by the openings in the spacer to define dome-shaped projections surrounded by an annular ring. The underside of the dome has a conductive material thereon. Disposed between the outer side of the domeshaped projection and a flexible plastic cover layer which is affixed to the top side of the spacer layer is a "spider" which is supported by the side walls of the apertures in the spacer. The cover layer is imprinted with indicia to visually define the switch positions. Depression of the cover layer with a finger or through a plastic key, acts through the spider to invert the dome with respect to the annular ring to thereby bring the bridging conductor into electrical engagement with the first and second switching contacts on the substrate. The combination of the spider member and the manner in which the dome-shaped projection is hinged to the annular ring provides the desired tactile feedback with substantially no edge toggling.

These and other features and advantages of the present invention will become apparent from a reading of the following detailed description of the preferred embodiment with the aid of the accompanying drawing in which:

DESCRIPTION OF THE PREFERRED EMBODIMENT

Figure 1:
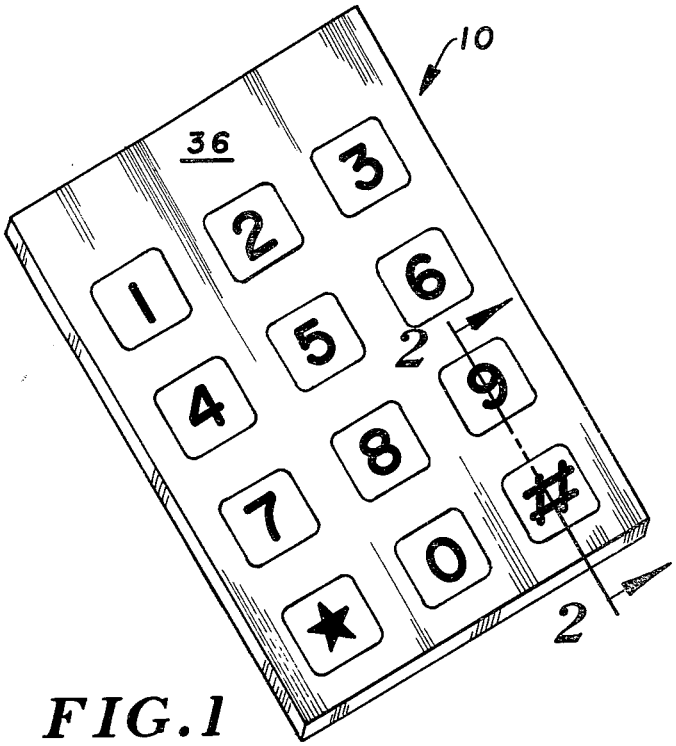
FIG. 1 is a pictorial top view of the tactile touch switch panel.

Referring now to FIG. 1, there is shown a switch panel 10 which defines an arrangement of four rows and three columns of switch positions. FIG. 1 is intended to be illustrative and not limitive in that the panel may include a greater or lesser number of switch positions than is actually illustrated. The switch panel 10 is of a sandwiched construction as can best be seen from the cross-sectional view of FIG. 2.

Figure 2:
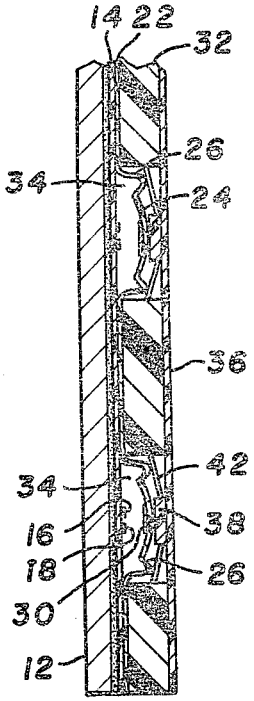
FIG. 2 is a cross-sectional view of the panel of FIG. 1 taken along the lines 2—2.

As is illustrated in FIG. 2, the sandwich includes a rigid backing layer 12 which may be formed from aluminum or plastic. The backing layer 12 has disposed thereon a flex-circuit layer 14 which may be a thin, flexible, Mylar sheet having a pattern of printed circuitry formed thereon. The flex-circuit layer 14 may have the printed circuit conductive pattern such as is illustrated in the LaMarche application, Ser. No. 825,204, filed Aug. 17, 1977, and assigned to the assignee of the present invention or, alternatively, may have a different pattern arrangement. In any event, the pattern includes first and second electrical contacts 16 and 18 which are disposed in a close, but non-contacting, parallel relationship with one another and printed wiring for connecting these parallel switch contacts to the outside world. The flex-circuit layer 14 may be adhesively secured to the backing plate 12 by a suitable bonding material which is illustrated in the enlarged cross-sectional view of FIG. 3 as the layer 20.

Disposed on top of the flex-circuit layer 14 is the so-called tactile layer 22 which is preferably also made from a Mylar polyester material which is preformed by pressing this sheet between a shaped die and a block of thick silicone rubber to provide a plurality of integrally formed convex domes 24 surrounded by an annular ring 26. However, the tactile layer 22 may be formed from other materials, including plastics or thin metal. The convex dome 24 is generally parabolic in shape and meets with the annular ring 26 along a circular line 28 at the intersection of the dome 24 with the annular ring 26. There is one such dome-shaped projection for each of the possible switch positions on the panel 10.

Disposed on the underside and in the neighborhood of the topmost part of the dome 24 is a bridging conductor 30 which may also be formed on the tactile layer 22 by conventional printed circuit techniques.

Figure 3:
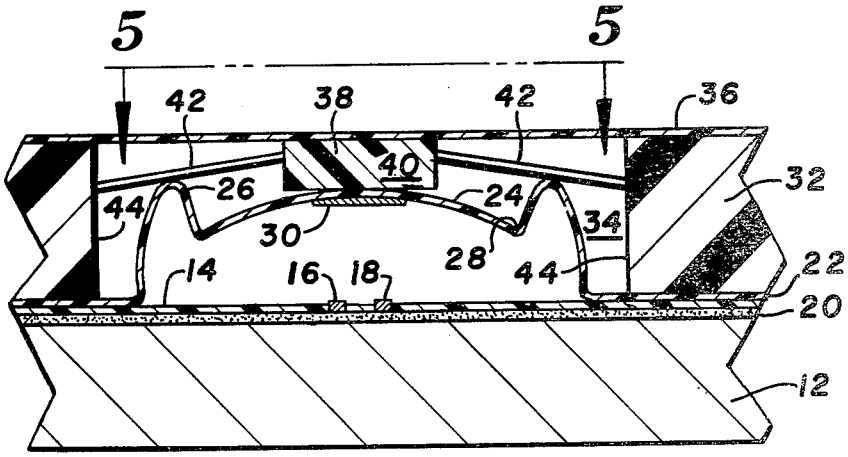
FIG. 3 is an enlarged view of one of the switch positions in its normal condition.

Disposed on top of the tactile layer 22 is a thin spacer member 32, preferably fabricated from a suitable insulating material. Formed through the thickness dimension of the spacer layer 32 are a plurality of openings or apertures 34, there being one such aperture for each of the switch positions on the panel 10. As is illustrated in FIGS. 2 and 3, the apertures 34 are arranged to be in registry with the dome-shaped projections 24 on the tactile layer 22. The opening 34 may be circular or rectangular in its plan view. Thus, the spacer layer 32 separates each of the possible switch positions, one from the other.

Completing the sandwich structure is a top layer 36 which is sufficiently thin to be flexible but which includes a memory property so that once deformed (within limits) will return to its original planar orientation. As such, a polyester film such as sold under the trademark Mylar is especially well suited. As is shown in FIG. 1, the top layer 36 is provided with printed indicia to define the areas of active switch positions. Of course, the printed indicia is in registration with the openings 34 in the spacer layer 32. The cover film 36 may be affixed to the spacer layer 32 by a suitable bonding material.

Figure 5:
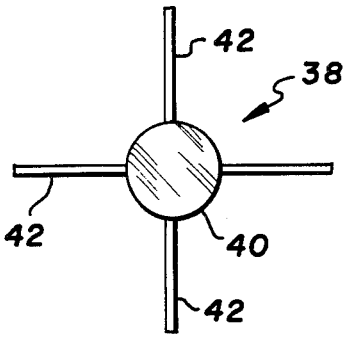
FIG. 5 is a top view of a first type of spider member used in the preferred embodiment.
Figure 7:
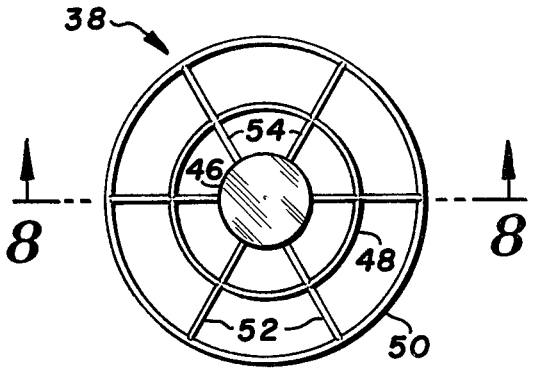
FIG. 7 is a top view of an alternative spider arrangement suitable for use in the preferred embodiment.
Figure 6:
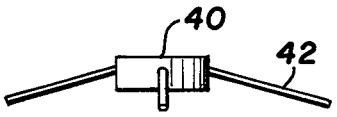
FIG. 6 is a side view of the spider element of FIG. 5.
Figure 8:
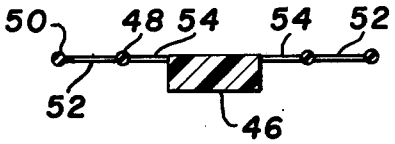
FIG. 8 is a cross-sectional view of the spider of FIG. 7.

Disposed between the top surface of the dome 24 and the underside of the top layer 36 is a spider member 38 which may have the configuration as defined by FIGS. 5 and 6 or, alternatively, that shown in FIGS. 7 and 8. With reference to FIGS. 5 and 6, in one arrangement the spider member 38 comprises a small circular button 40 having a plurality of thin flexible strips 42 extending therefrom. The strips 42 are adapted to engage the side walls 44 of the apertures 34 in the spacer member 32 so as to accurately position and hold the button element 40 in proximity to the topmost extension of the dome-shaped projection 24 during the course of assembly of the tactile touch panel. The thin strips 42 are, however, sufficiently thin and are of a material which may be readily deformed without providing a restoring force.

In FIGS. 7 and 8, an alternative construction of a spider element is disclosed wherein the button element 46 is surrounded by a plurality of concentric, spaced apart circular members 48, 50. The concentric circles 48 and 50 are held one to the other by means of the radially extending, integrally formed ribs 52. Similarly, the innermost circular element 48 is connected to the button element 46 by the radially extending ribs 54. Again, the purpose of the radially extending ribs and concentric circles are to provide a means whereby the button element 46 may be accurately maintained in position at the topmost point of the dome-shaped projections 24 during the assembly of the switch panel. The ribs 52 and 54 are sufficiently thin and formed from a suitable material so as to be easily deformed in a vertical direction without having an inherent, internal restoring property.

For purposes of illustration only, a touch panel made in accordance with the teachings of the present invention may have the following dimensions:

Panel thickness; 0.25 cm.
Thickness of tactile layer 22; 0.013 cm.
Aperture size; 2.54 cm. × 2.54 cm.
Radius of curvature of dome; 1.524 cm.
Diameter of dome; 0.8 cm.
Height of dome above layer 14; 0.10 cm.
Diameter of annular ring; 1.00 cm. (ave.)
Height of annular ring above layer 14; 1.064 cm.
Spider thickness - legs; 0.013 cm.
Spider thickness - center; 0.08 cm.

The relative dimensions of the apertures 34 with respect to the thickness of the spacer layer 32 is such that substantially no visually perceptible deformation of the top layer 36 occurs during actuation of a given switch position.

Now that the physical construction of the switch panel of the present invention has been set forth in detail, consideration will be given to its mode of operation.

OPERATION

Figure 4:
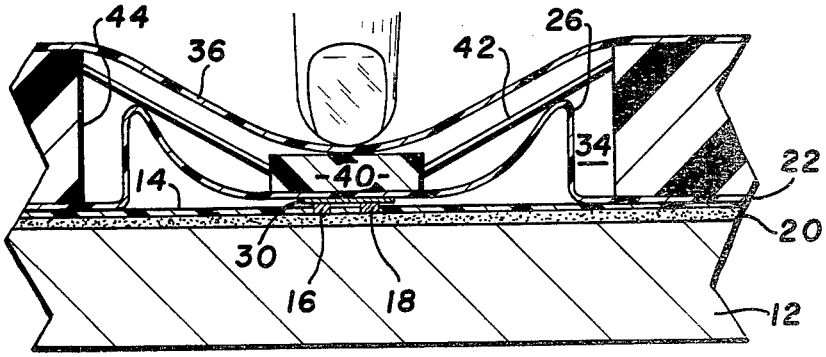
FIG. 4 is an enlarged view of one switch position in its depressed condition.

With reference to FIGS. 3 and 4 which shows a greatly exaggerated view of one switch position, when a downward force is applied to the upper cover sheet 36 in the area identified by the printed indicia thereon as a switch location, the membrane 36 deforms visually imperceptively, downward and applies a downward force through the spider button element 38 to the tactile layer 22, specifically to the top of the dome-shaped projection 24 thereof. This force distorts the dome 24 downward and a point is reached wherein the dome 24 suddenly collapses downward about the ring shaped projection 26 as a hinge (at the circumferential boundary line 28) such that the bridging conductor element 30 engages the first and second contact elements 16 and 18 on the flex-circuit layer 14. Thus, electrical continuity is established between the contact segments 16 and 18 via the bridging conductor 30. The switch in its closed condition is illustrated in FIG. 4.

When the finger force is removed, the "memory" property of the tactile layer 22 exerts an upward force tending to lift the spider element 40 so as to resume its original configuration as illustrated in FIG. 3. If the cover membrane 36 is adhesively fixed to the topmost surface of the spider element 40, the memory property of the layer 36 tending to restore the membrane 36 to its undistorted condition also assists in lifting the spider member 40 upward.

Because of the unique shape of the preformed dimple on the layer 22 and because of the inclusion of the spider element 38 in the assembly, a positive tactile feedback signal is provided to the operator indicative of a contact closure, without the presence of the edge toggle phenomena. The hinge area between the annular ring 26 and the convex dome 24 tends to ensure a total collapse of the dome 24 when sufficient force is applied and this sudden collapse ensures that the briding contact 30 will strike and abruptly stop on the flex-layer 22. The spider element 38, whether it be of the design shown in FIG. 5 or in FIG. 7, tends to spread out the downward force along the surface of the dome 24 as the downward force progresses to further ensure a complete, rather than a partial, collapse of the dome 24.

The panel configuration shown in FIG. 1 is adapted to be operated directly by the finger of a person using same. It is to be understood, however, that the panel of FIG. 1 may be located directly below a further cover panel having apertures therethrough, through which plastic key members may pass. The bottom of such plastic keys would be made to contact the panel 10 in the areas defined as switching positions by the indicia thereon. In this application, the plastic button would merely be an extension of the operator's finger.

It will be appreciated from the foregoing that I have provided an apparatus for implementing a touch-type switch panel of surprisingly simple and inexpensive construction, yet having increased effectiveness, reliability and "feel". The touch panel made in accordance with the teachings of the present invention results in an unusually thin, compact device having a low contact travel during actuation. Because of the simplicity, low cost and increased reliability due to the sealed environment in which the switch contacts reside, devices made in accordance with the present invention are attractive for use with many types of digital data processing equipment and particularly for use in low cost, hand-held or desk-type calculators and the like.

While only a preferred embodiment of the present invention has been specifically described, it will be appreciated that many variations may be made therein without departing from the scope of the invention. For example, rather than providing a tactile layer having integrally formed dome-shaped projections, it is also possible to utilize a plurality of individual domes, one being located in each of the spacer apertures in registry with the switching contacts on the flex-layer and having a conductive area comprising the bridging contact. Hence, the scope of the invention is to be determined by the following claims.

I claim:

1. A tactile feedback electrical switch assembly for intermittently altering the electrical condition of normally spaced apart conductors and comprising:

(a) base pad means for receiving and retaining said electrical switching assembly thereon;

(b) a first insulative film having means insulatively mounting a plurality of spaced apart electrical switching conductors upon said base pad means with mutally adjacent conductors of said electrical switching conductor forming a pair of switch contacts;

(c) a tactile layer having a plurality of dome-shaped projections formed therein with said layer being arranged for mounting upon said base pad means in superimposed relationship with said first insulative film, and with each of said dome-shaped projections being in substantial registration with one discrete pair of switch contacts on said first insulative film and with an electrical conductor bridging contact area on the inner surface of said tactile layer within said dome and in substantial registration with said contacts; and (d) said dome-shaped projection comprising a generally parabolic disc with a raised center portion and an annular ring projecting upwardly and outwardly from the edge of said parabolic disc, said annular ring joining said parabolic disc along a generally circular transition line, said transition line normally being located at the apex of an angle which is generally acute from the upper surface of said dome-shaped projection and wherein the upper surface of said parabolic disc extends above that of said annular ring, the arrangement being such that upon depression of said parabolic disc, said annular ring functions as a hinge for accommodating inversion of said parabolic disc and resultant contact between said bridging contact and said switch contacts.

2. The tactile feedback electrical switch assembly as in claim 1 and further including:

(a) a spacer layer of a predetermined thickness and having a plurality of apertures formed therethrough, said spacer layer being disposed on said first insulative film on said base pad, each of said apertures being in registration with individual ones of said bridging contact areas and each containing one of said plurality of dome-shaped projections.

3. The device as in claim 2 and further including:

(a) a second flexible insulative film having indicia marked thereon in a predetermined orientation defining a plurality of switch positions, said second film being affixed to the upper surface of said spacer layer with said switch positions being in registration with corresponding apertures in said spacer layer.

4. The device as in claim 3 and further including:

(a) a plurality of rigid members each having radially extending flexible projections, said rigid members being individually disposed between the outer top surfaces of said parabolic discs and the inner surface of said second flexible insulative film, said radially extending flexible projections supportively engaging the side walls of said apertures formed in said spacer layer, to provide tactile feedback to the finger of an operator depressing said second flexible insulative film in the area of said switch positions.

5. Apparatus as in claim 4 wherein said radially extending flexible projections comprise:

(a) thin, flexible strips extending outwardly and downwardly from said rigid members, adjacent ones of said strips being substantially at right angles to one another.

6. Apparatus as in claim 4 wherein said radially extending flexible projections comprise:

(a) a plurality of concentric circles of material surrounding said rigid member; and (b) a plurality of thin, flexible strips of the same material extending radially from said rigid member joining said concentric circles to one another and to said rigid member.

7. Apparatus as in claim 1 wherein said tactile layer comprises a third insulating film having a conductive coating on at least a portion of said inner surface of said third insulating film within said dome.

* * * * *